US012693040B2

(12) United States Patent
Hosomi et al.

(10) Patent No.: US 12,693,040 B2
(45) Date of Patent: Jul. 28, 2026

(54) AIR CONDITIONER WITH MULTIPLE FANS AND RELATED CONTROL METHOD

(71) Applicant: Mitsubishi Electric Corporation, Tokyo (JP)

(72) Inventors: Shota Hosomi, Tokyo (JP); Koji Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 172 days.

(21) Appl. No.: 18/262,031

(22) PCT Filed: Jan. 31, 2022

(86) PCT No.: PCT/JP2022/003528

§ 371 (c)(1),
(2) Date: Jul. 19, 2023

(87) PCT Pub. No.: WO2023/286298

PCT Pub. Date: Jan. 19, 2023

(65) Prior Publication Data

US 2024/0060674 A1 Feb. 22, 2024

(30) Foreign Application Priority Data

Jul. 14, 2021 (WO) ..... PCT/JP2021/026385

(51) Int. Cl.
*F24F 11/74* (2018.01)
*F24F 1/00* (2019.01)
(Continued)

(52) U.S. Cl.
CPC ..... *F24F 11/74* (2018.01); *F24F 1/0033* (2013.01); *F24F 11/0008* (2013.01);
(Continued)

(58) Field of Classification Search
CPC .... F25B 2313/02331; F25B 2313/0293; F24F 1/0033; F24F 1/0083
See application file for complete search history.

(56) References Cited

U.S. PATENT DOCUMENTS

2006/0254294 A1* 11/2006 Shimamoto ..... F25B 13/00 62/238.7
2009/0140059 A1* 6/2009 Barton ..... F24F 11/30 236/51

(Continued)

FOREIGN PATENT DOCUMENTS

CN 108036436 A 5/2018
CN 108375177 A 8/2018

(Continued)

OTHER PUBLICATIONS

International Search Report of the International Searching Authority mailed Apr. 5, 2022 in corresponding International Application No. PCT/JP2022/003528 (and English translation).

(Continued)

*Primary Examiner* — Jerry-Daryl Fletcher
*Assistant Examiner* — Daniel C Comings
(74) *Attorney, Agent, or Firm* — Posz Law Group, PLC

(57) ABSTRACT

An air conditioner includes an outdoor unit, and a plurality of indoor units connected with a refrigerant pipe through which a refrigerant sent from the outdoor unit flows. Each indoor unit includes a refrigerant circuit in which at least an indoor heat exchanger is connected to the refrigerant pipe, an operation controller configured to control the refrigerant circuit according to an operating state, a sensor configured to measure an indoor environment, and a plurality of indoor fans configured to blow air to the indoor heat exchanger. Further, during a dehumidifying operation, the operation controller is configured to control the plurality of indoor fans (Continued)

respectively at different rotation speeds based on a result of the measurement by the sensor.

18 Claims, 6 Drawing Sheets

(51) Int. Cl.
*F24F 1/0033* (2019.01)
*F24F 11/00* (2018.01)
*F24F 110/10* (2018.01)
*F24F 110/20* (2018.01)

(52) U.S. Cl.
CPC ..... *F24F 2110/10* (2018.01); *F24F 2110/20* (2018.01); *F25B 2313/02333* (2013.01); *F25B 2600/112* (2013.01)

(56) References Cited

U.S. PATENT DOCUMENTS

| | | | | |
|---|---|---|---|---|
| 2012/0291463 | A1* | 11/2012 | O'Brien | F24F 3/1405 62/126 |
| 2017/0023264 | A1* | 1/2017 | Ha | F24F 11/46 |
| 2018/0100677 | A1 | 4/2018 | Sekiya et al. | |

FOREIGN PATENT DOCUMENTS

| | | | | | |
|---|---|---|---|---|---|
| CN | 110848804 | A | * | 2/2020 | F24F 1/0033 |
| GB | 2467354 | A | * | 8/2010 | F04D 25/16 |
| JP | H04-009539 | A | | 1/1992 | |
| JP | 2000-146315 | A | | 5/2000 | |
| JP | 2007-032933 | A | | 2/2007 | |
| JP | 2014-020583 | A | | 2/2014 | |
| JP | 2014-153008 | A | | 8/2014 | |
| JP | 2016-205732 | A | | 12/2016 | |
| JP | 2019-184218 | A | | 10/2019 | |
| WO | 2020/035909 | A1 | | 2/2020 | |

OTHER PUBLICATIONS

International Search Report of the International Searching Authority mailed Sep. 21, 2021 in corresponding International Application No. PCT/JP2021/026385 (and English translation).

Office Action mailed Mar. 31, 2026 issued in the corresponding Chinese Patent Application No. 202280021162.6 (and English machine translation).

* cited by examiner

AIR CONDITIONER WITH MULTIPLE FANS AND RELATED CONTROL METHOD

CROSS REFERENCE TO RELATED APPLICATIONS

This application is a U.S. national stage application of International Application No. PCT/JP2022/003528 filed on Jan. 31, 2022, which claims priority based on International Application No. PCT/JP2021/026385 filed on Jul. 14, 2021, the contents of which are incorporated herein by reference.

TECHNICAL FIELD

The present disclosure relates to an air conditioner and a control method for the air conditioner.

BACKGROUND

Conventionally, heat-pump air conditioners using a refrigerant circuit are known, some of which have a function of performing a dehumidifying operation (see, for example, Patent Document 1). Patent Document 1 discloses an air conditioner that controls a rotation speed of an indoor fan during the dehumidifying operation, thereby controlling a temperature of a heat exchanger and a latent heat ratio.

PATENT DOCUMENT

[Patent Document 1] Japanese Patent Application Publication No. 2014-153008

When only the rotation speed of one indoor fan is controlled as in Patent Document 1, however, a control range of an air volume is narrow. For this reason, there are cases where a balance between latent heat and sensible heat taken from indoor air deteriorates, and moisture adhering to the heat exchanger re-evaporates, so that an indoor temperature drops too much, while an indoor humidity does not drop so much despite the dehumidifying operation.

SUMMARY

The present disclosure has been made in view of the circumstances described above, and one of the objects thereof is to provide an air conditioner that can dehumidify a room while suppressing an excessive drop in an indoor temperature.

An air conditioner according to the present disclosure includes: one outdoor unit; and at least two indoor units connected with a refrigerant pipe through which a refrigerant sent from the one outdoor unit flows. Each of the at least two indoor units includes: a refrigerant circuit in which at least an evaporator is connected to the refrigerant pipe; an operation controller configured to control the refrigerant circuit according to an operating state; a temperature sensor configured to measure an indoor temperature; and at least two indoor fans configured to blow air to the evaporator. The operation controller is configured to, during a dehumidifying operation, when the temperature measured by the temperature sensor is higher than a preset temperature threshold, control each of the at least two indoor fans to rotate at a first rotation speed. The operation controller is configured to, during the dehumidifying operation, when the temperature is equal to or lower than the preset temperature threshold, control at least one indoor fan among the at least two indoor fans to rotate at the first rotation speed, and other indoor fans than the at least one indoor fan to rotate at a second rotation speed lower than the first rotation speed.

Further, an air conditioner according to the present disclosure includes: one outdoor unit; and at least two indoor units connected with a refrigerant pipe through which a refrigerant sent from the one outdoor unit flows. Each of the at least two indoor units includes: a refrigerant circuit in which at least an evaporator is connected to the refrigerant pipe; an operation controller configured to control the refrigerant circuit according to an operating state; a humidity sensor configured to measure an indoor humidity; and at least two indoor fans configured to blow air to the evaporator. The operation controller is configured to, during a dehumidifying operation, when the indoor humidity measured by the humidity sensor is equal to or lower than a preset humidity threshold, control at least one indoor fan among the at least two indoor fans to stop rotating. The operation controller is configured to, during the dehumidifying operation, when the indoor humidity measured by the humidity sensor is higher than the preset humidity threshold, control the at least two indoor fans to keep rotating.

Further, a control method according to the present disclosure is for an air conditioner including one outdoor unit and at least two indoor units, each of the at least two indoor units including at least two indoor fans. The control method includes: during a dehumidifying operation, when an indoor humidity is equal to or lower than a preset humidity threshold, controlling at least one indoor fan among at least two indoor fans to stop rotating; and during the dehumidifying operation, when the indoor humidity is higher than the preset humidity threshold, controlling the at least two indoor fans to keep rotating.

According to the present disclosure, it is possible to dehumidify a room while suppressing an excessive drop in an indoor temperature.

DETAILED DESCRIPTION

Hereinafter, embodiments will be described with reference to the drawings.

First Embodiment

First, a first embodiment will be described.

[Configuration of Air Conditioner]

Figure 1:
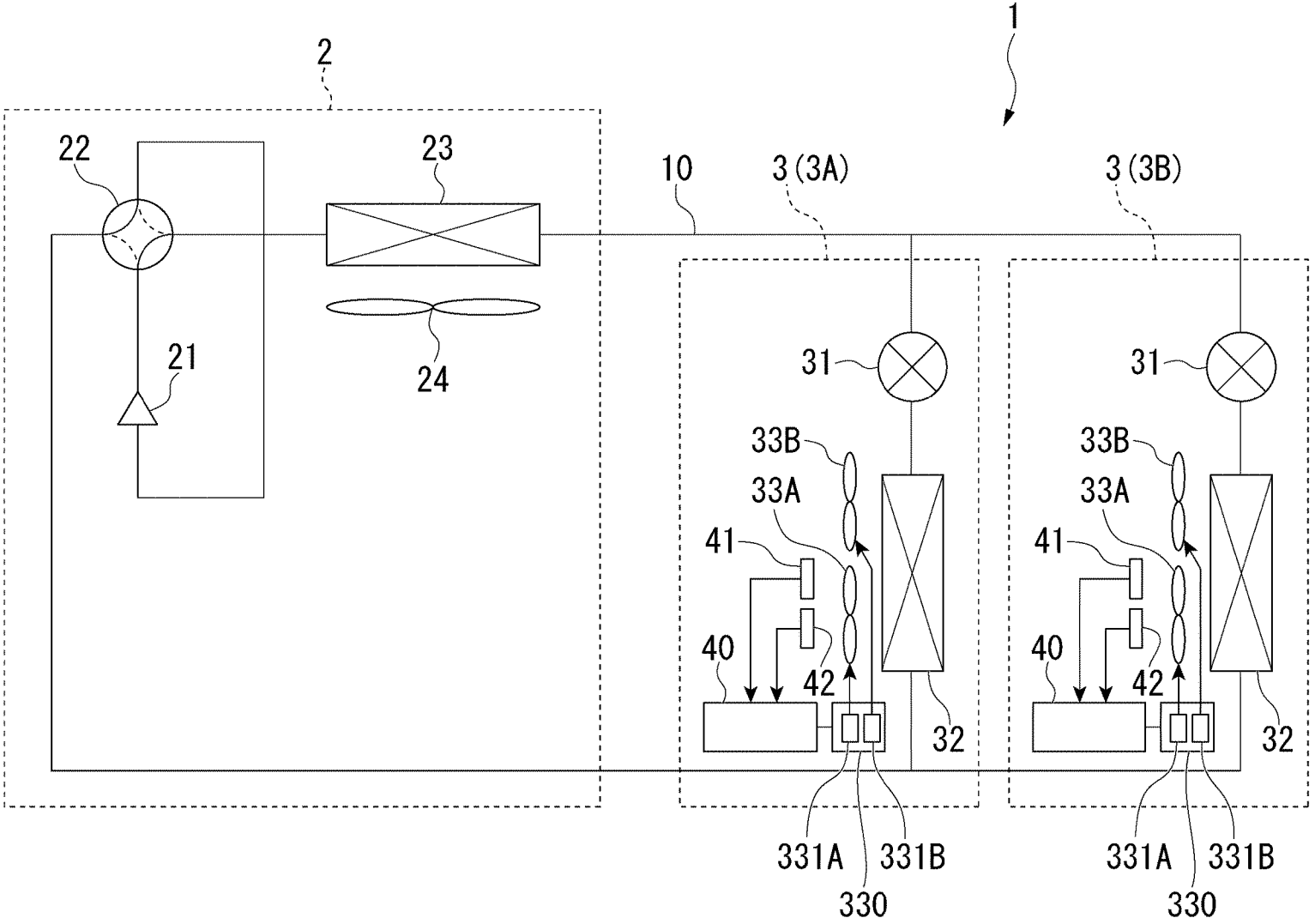
FIG. 1 is a block diagram showing a schematic configuration example of an air conditioner according to a first embodiment.

FIG. 1 is a block diagram showing a schematic configuration example of an air conditioner according to the present embodiment. An illustrated air conditioner 1 is a multi-type air conditioner in which a plurality of indoor units 3 are connected to one outdoor unit 2. For example, the air conditioner 1 is installed in a building, a condominium, or the like, and each of the plurality of indoor units 3 connected to the one outdoor unit 2 is installed in a room (a room to be air-conditioned) that is an area targeted for a respective air conditioning. The air conditioner 1 has functions of cooling, heating, and dehumidifying each of indoor spaces installed respectively with the plurality of indoor units 3. Here, the air conditioner 1 may be a device having the functions of at least cooling and dehumidifying.

This FIG. 1 shows an example in which the two indoor units 3, which are an indoor unit 3A and an indoor unit 3B, are connected to the one outdoor unit 2. Here, the number of indoor units 3 connected to the outdoor unit 2 may be three or more. The air conditioner 1 has a refrigerant circuit 10 in which the indoor unit 3A and the indoor unit 3B are connected to the outdoor unit 2 by refrigerant pipes.

For example, the outdoor unit 2 is installed outside a building, a condominium, or the like. The outdoor unit 2 is connected to the indoor unit 3A and the indoor unit 3B by the refrigerant pipes, and constitutes a part of the refrigerant circuit 10. That is, the outdoor unit 2, the indoor unit 3A, and the indoor unit 3B are configured such that a refrigerant circulates through the refrigerant pipes. The outdoor unit 2 circulates the refrigerant through the refrigerant circuit 10, thereby supplying cold heat or hot heat to the indoor units 3A and 3B.

The illustrated outdoor unit 2 includes a compressor 21, a switching valve 22 that switches a flow direction of the refrigerant between a cooling operation and a heating operation, and an outdoor heat exchanger 23 as a heat source side heat exchanger, each of which is connected in series via the refrigerant pipes as a part of the refrigerant circuit 10. The outdoor unit 2 also includes an outdoor fan 24 that blows air to the outdoor heat exchanger 23.

For example, the indoor unit 3 (3A, 3B) is a ceiling-embedded type indoor unit that is embedded in a ceiling of a room in a building, a condominium, or the like, a ceiling-mounted type indoor unit that is suspended from the ceiling, or a wall-mounted type indoor unit that is hung on an indoor wall surface. Here, basic configurations of the indoor unit 3A and the indoor unit 3B are the same. The indoor unit 3A and the indoor unit 3B will be described as the indoor unit 3 unless otherwise distinguished from each other. Each indoor unit 3 is supplied with cold heat or hot heat from the outdoor unit 2, and cools or heats the indoor air in which it is installed.

The illustrated indoor unit 3 includes an expansion device 31 as an expansion mechanism, and an indoor heat exchanger 32 as a user-side heat exchanger, each of which is connected in series through a refrigerant pipe as a part of the refrigerant circuit 10. Further, the indoor unit 3 also includes two indoor fans 33A and 33B that blow air to the indoor heat exchanger 32. The indoor unit 3 includes a driver 330 that drives the rotation of the indoor fans 33A and 33B. The driver 330 includes an actuator 331A for driving the rotation of the indoor fan 33A and an actuator 331B for driving the rotation of the indoor fan 33B.

Figure 2:
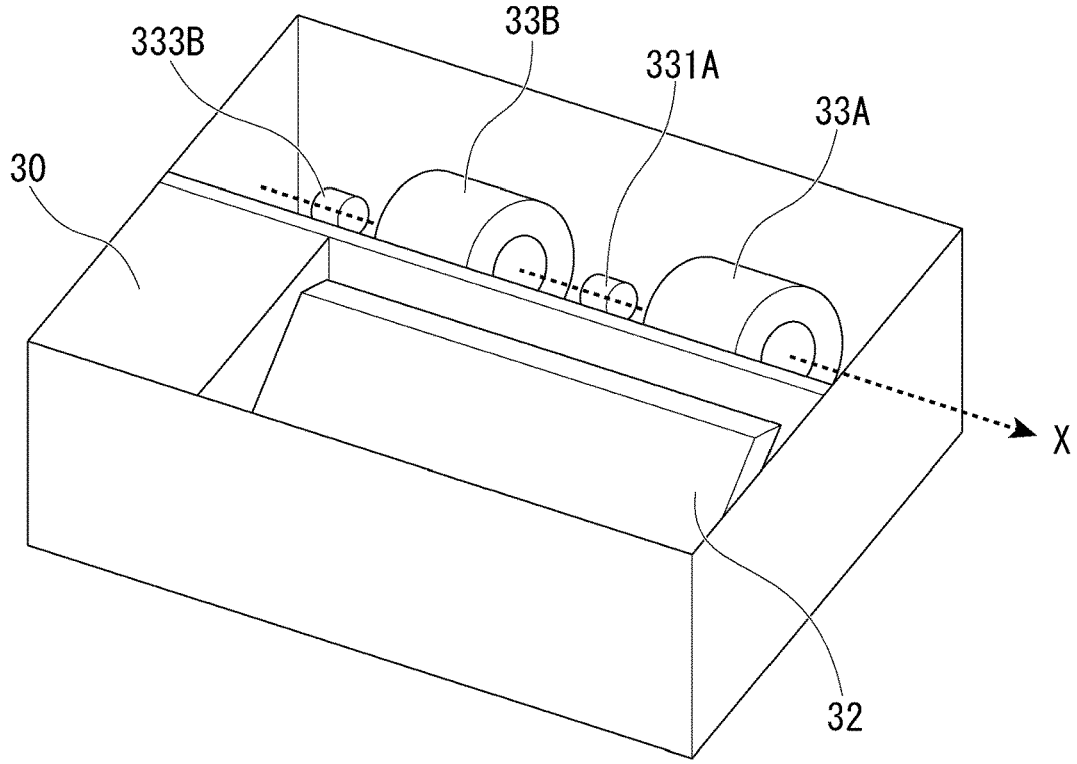
FIG. 2 is a schematic diagram showing an example of an internal configuration of an indoor unit according to the first embodiment.

FIG. 2 is a schematic diagram showing an example of an internal configuration of the indoor unit 3. A piping component 30 is provided with the expansion device 31, the refrigerant pipe connecting the expansion device 31 and the indoor heat exchanger 32, and the like. Further, the indoor fans 33A and 33B are arranged side by side in a direction of a rotation axis X so that the direction of the long axis (rotation axis X) corresponds to a longitudinal direction of the indoor heat exchanger 32. The indoor fans 33A and 33B rotate around the rotation axis X to blow the air taken from the room to the indoor heat exchanger 32. Due to this air flow, the air heat-exchanged by the indoor heat exchanger 32 is sent out from the indoor unit 3 and returned to the indoor space. During the cooling operation, the cold air heat-exchanged and cooled by the indoor heat exchanger 32 is sent indoors. During the heating operation, the warm air heated by heat exchange in the indoor heat exchanger 32 is sent indoors. As the number of rotations of the indoor fans 33A and 33B is increased to a higher rotation speed, the amount of air blown to the indoor heat exchanger 32 increases, and the amount of cold air or warm air sent indoors increases.

Although one indoor fan is provided normally, the two indoor fans 33A and 33B separated in the direction of the long axis (rotation axis X) are provided in the present embodiment. Here, it is assumed that each of the two indoor fans 33A and 33B blows air to the indoor heat exchanger 32 in a range about half that of one indoor fan, and the amount of air to be heat-exchanged is also about half. That is, when one indoor fan, and the two indoor fans 33A and 33B obtained by dividing one indoor fan, are rotated at the same rotation speed, the capacity of each of the two indoor fans 33A and 33B (cooling or heating capacity) corresponds to about half the capacity of the one indoor fan. In other words, the total capacity of the two indoor fans 33A and 33B corresponds to the capacity of the one indoor fan.

Although the case where the two indoor fans 33A and 33B are mounted is illustrated here, three or more indoor fans may be mounted. In that case, the indoor unit 3 is provided with the same number of actuators for driving the respective indoor fans as the number of indoor fans. Here, when three or more indoor fans are mounted, the number of indoor fans and the number of actuators need not match. That is, some of two or more actuators may be configured to drive a plurality of indoor fans.

Returning to FIG. 1, the indoor unit 3 includes an operation controller 40. The operation controller 40 controls the refrigerant circuit 10 according to an operating state such as cooling or heating. Further, the operation controller 40 controls the actuator 331A, thereby controlling the rotation and stop of the indoor fan 33A, the number of rotations (rotation speed) of the indoor fan 33A during rotation, and the like. Further, the operation controller 40 control the actuator 331B, thereby controlling the rotation and stop of the indoor fan 33B, the number of rotations (rotation speed) of the indoor fan 33B during rotation, and the like. That is, the operation controller 40 can individually control the indoor fan 33A and the indoor fan 33B.

Further, the indoor unit 3 includes a sensor that measures an indoor environment. For example, the indoor unit 3 includes a temperature sensor 41 for measuring an indoor temperature and a humidity sensor 42 for measuring an indoor humidity. The operation controller 40 controls each of the indoor fans 33A and 33B based on operating conditions set by a user (for example, a temperature setting, an air volume setting, etc.), results of measurements by the temperature sensor 41 and the humidity sensor 42, and the like. Here, it is assumed in the present embodiment that the temperature sensor 41 and the humidity sensor 42 are provided on the side of the indoor fan 33A among the indoor fans 33A and 33B, as shown in FIG. 1.

Figure 3:
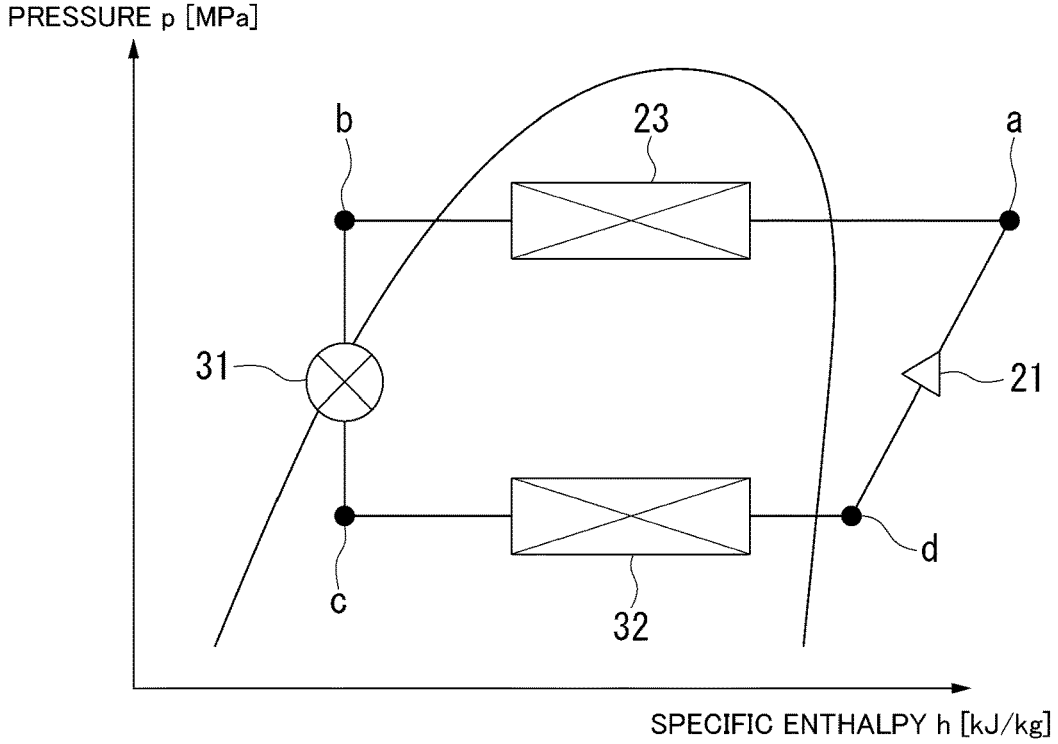
FIG. 3 is a p-h diagram during a cooling operation of the air conditioner according to the first embodiment.

FIG. 3 shows an example of a p-h diagram during the cooling operation of the air conditioner 1. An operation example of the air conditioner will be described with reference to FIGS. 1 and 3. First, in the outdoor unit 2, a low-temperature, low-pressure refrigerant is compressed by the compressor 21 and discharged as a high-temperature, high-pressure gas refrigerant (point a shown in FIG. 2). The high-temperature, high-pressure gas refrigerant discharged from the compressor 21 flows into the outdoor heat exchanger 23. The refrigerant that has flowed into the outdoor heat exchanger 23 is condensed and liquefied while radiating heat to the outdoor air by the blowing action of the outdoor fan 24 (point b shown in FIG. 2).

Thereafter, the high-pressure liquid refrigerant that has flowed out of the outdoor heat exchanger 23 is decompressed by the expansion device 31 to become a low-pressure gas-liquid two-phase refrigerant (point c in FIG. 2), and flows out of the outdoor unit 2. The low-pressure gas refrigerant that has flowed out of the outdoor unit 2 flows into the indoor unit 3 and into the indoor heat exchanger 32, where it absorbs heat from the air due to the blowing action of the indoor fans 33A and 33B, thereby evaporating into gas (point d shown in FIG. 2). At this time, the room is cooled by the indoor heat exchanger 32 and the indoor fans 33A and 33B. Thereafter, the refrigerant flows into the outdoor unit 2 and is sucked into the compressor 21 again.

Here, in addition to the cooling operation described above, the air conditioner 1 has a function of dehumidifying a room. In the dehumidifying operation, the air conditioner 1 performs a weak cooling and dehumidifying operation so that the refrigerant flow (cooling cycle) is the same as in the cooling operation, and a sensible heat factor (SHF) is lower than that in the cooling operation.

Conventionally, when the dehumidifying operation (weak cooling and dehumidifying operation) is performed, there are cases where the indoor temperature drops more than necessary, thereby impairing the comfort. In the dehumidifying operation (weak cooling and dehumidifying operation), in order to make the sensible heat ratio lower than that in the cooling operation, for example, it is possible to control a temperature of the refrigerant in the indoor heat exchanger 32 and an air volume of the indoor fan.

However, in the case of the multi-type air conditioner 1 as shown in FIG. 1, for example, there is a case where the indoor unit 3A performs the dehumidifying operation, while the indoor unit 3B performs the cooling operation. That is, when a plurality of indoor units 3 are connected, a temperature of the refrigerant cannot be determined by an operating state of one indoor unit 3. Therefore, it is necessary to control the air volume of the indoor fan without relying on the control of the temperature of the refrigerant in the indoor heat exchanger 32, thereby lowering the sensible heat ratio during the dehumidifying operation than during the cooling operation. Further, in order to measure indoor environments, it is necessary to pass air through the temperature sensor 41 and the humidity sensor 42 included in the indoor unit 3. Therefore, when there is only one indoor fan as in the conventional cases, a setting range of the air volume is narrow, so that it is difficult to lower the sensible heat ratio.

For this reason, in the present embodiment, while at least two (here, the indoor units 3A and 3B) of the plurality of indoor units 3 are operating in the cooling cycle, and at least one of them is performing the dehumidifying operation, the at least one indoor unit 3 performing the dehumidifying operation individually controls the air volume of each of the two indoor fans 33A and 33B. For example, the operation controller 40 controls the two indoor fans 33A and 33B to respectively rotate at different rotation speeds. As described above, since the capacity of each of the two indoor fans 33A and 33B is about half the capacity of one indoor fan obtained by combining the indoor fans 33A and 33B, it is possible to adjust the air volume more finely by controlling the indoor fans 33A and 33B to respectively rotate at different rotation speeds. As a result, the setting range of the air volume is expanded, so that the sensible heat ratio can be appropriately controlled.

For example, assuming that an air volume of one indoor fan when operated at the lowest speed is "1," in order to realize this air volume of "1" with the two indoor fans 33A and 33B as in the present application, the air volume of each of the two indoor fans 33A and 33B when operated at the lowest speed will be about half, that is, "0.5" each. Then, if any one of the two indoor fans 33A and 33B is controlled to rotate at the lowest speed, and the remaining one of the indoor fans is controlled to stop, the air volume is not "1," but can be "0.5." As a result, the air volume can be reduced when a plurality of indoor fans are used, compared with when one indoor fan is used, so that an allowable setting range of the air volume can be expanded. Since the setting range of the air volume can be expanded, the sensible heat ratio can be controlled more appropriately.

Further, when an indoor fan is rotating after the set humidity is reached, the moisture adhering to the indoor heat exchanger 32 evaporates, so that the room may be humidified even though the dehumidifying operation is being performed.

For this reason, the operation controller 40 not only controls the two indoor fans 33A and 33B to rotate at different rotation speeds to expand the setting range of the air volume, but also may control one of the indoor fans 33A and 33B to rotate and the other one of them to stop rotating. For example, the operation controller 40 controls the indoor fan 33A to rotate to keep the air blown to the temperature sensor 41 and the humidity sensor 42, thereby enabling measurements of an indoor temperature and a humidity, while controlling the indoor fan 33B to stop to suppress the amount of air blown to the indoor heat exchanger 32, thereby enabling suppression of re-evaporation of the moisture.

Figure 4:
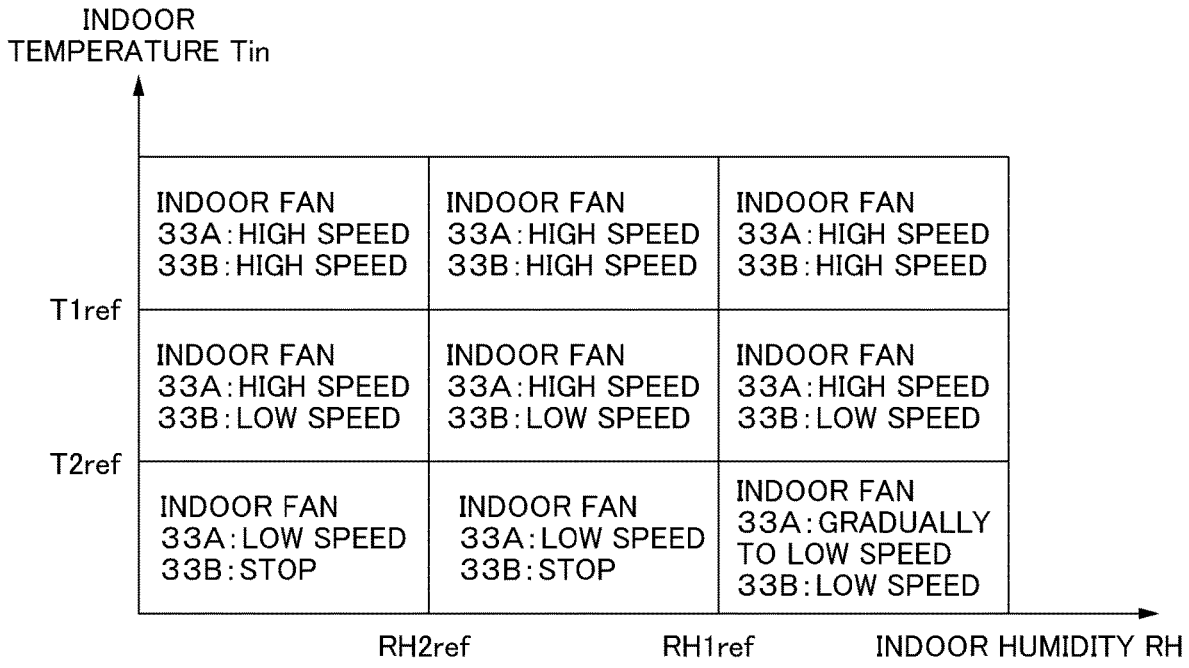
FIG. 4 is a schematic diagram showing a setting example of modes for controlling indoor fans during a dehumidifying operation according to the first embodiment.

FIG. 4 is a schematic diagram showing a setting example of modes for controlling the indoor fans 33A and 33B during the dehumidifying operation. In this figure, a vertical axis indicates an indoor temperature Tin measured by the temperature sensor 41, and a first temperature threshold T1ref and a second temperature threshold T2ref lower than the first temperature threshold T1ref are preset. On the other hand, a horizontal axis indicates an indoor humidity RH measured by the humidity sensor 42, and a first humidity threshold RH1ref and a second humidity threshold RH2ref lower than the first humidity threshold RH1ref are preset. The modes for controlling the indoor fans 33A and 33B are classified and set according to the thresholds of the indoor temperature and the indoor humidity.

Here, settings of the number of rotations as the modes for controlling the indoor fans 33A and 33B are classified into "high speed rotation," "low speed rotation," and "stop." The "high-speed rotation" is a mode for controlling the rotation speed to be relatively higher than the "low-speed rotation." The "low-speed rotation" is a mode for controlling the rotation speed to be relatively lower than the "high speed rotation." The "stop" is a state in which the rotation is stopped.

When the indoor temperature Tin is higher than the first temperature threshold T1ref, both the indoor fans 33A and 33B are set to the high-speed rotation, regardless of the indoor humidity RH. When the indoor temperature Tin is equal to or lower than the first temperature threshold T1ref, but higher than the second temperature threshold T2ref, the indoor fan 33A is set to the high speed rotation, and the indoor fan 33B is set to the low speed rotation, regardless of the indoor humidity RH.

When the indoor temperature Tin is equal to or lower than the second temperature threshold T2ref, and the indoor humidity RH is higher than the first humidity threshold RH1ref, the indoor fan 33A is set to a mode for controlling the indoor fan 33A to gradually decelerate at a predetermined rate to shift from the high-speed rotation to the low-speed rotation, while the indoor fan 33B is set to the low-speed rotation. Further, when the indoor temperature Tin is equal to or lower than the second temperature threshold T2ref, and the indoor humidity RH is equal to or lower than the first humidity threshold RH1ref, the indoor fan 33A is set to the low-speed rotation, and the indoor fan 33B is set to the stop.

The operation controller 40 refers to the settings of the control modes shown in FIG. 4 and controls the indoor fans 33A and 33B based on the indoor temperature measured by the temperature sensor 41 and the indoor humidity measured by the humidity sensor 42.

Figure 5:
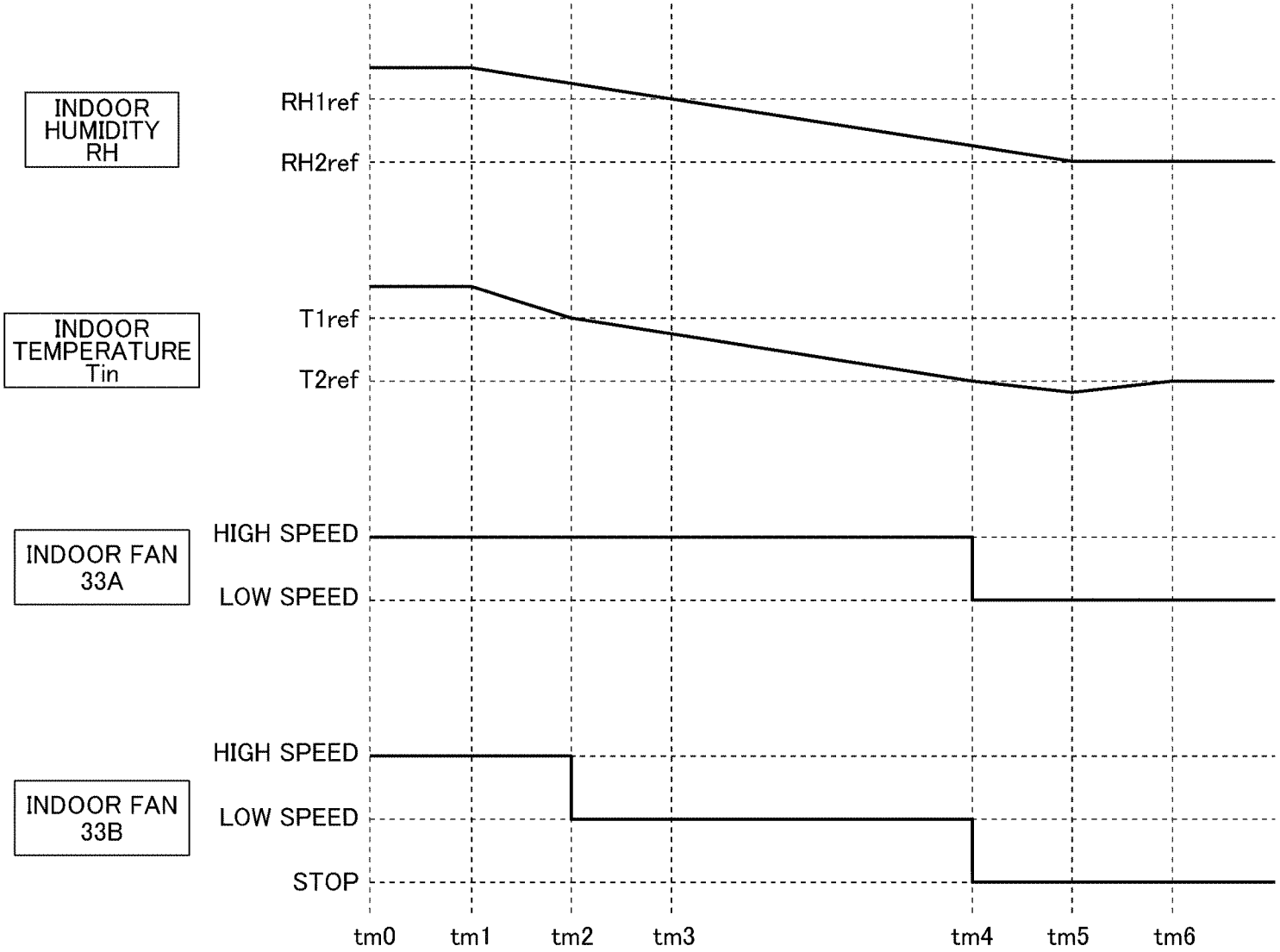
FIG. 5 is a timing chart showing an example of controlling the indoor fans during the dehumidifying operation according to the first embodiment.

FIG. 5 is a timing chart showing an example of controlling the indoor fans 33A and 33B during the dehumidifying operation. In this figure, a horizontal axis indicates time, and a vertical axis indicates indoor humidity RH, indoor temperature Tin, and control for the indoor fans 33A and 33B.

In a period from a time tm0 to a time tm2, the indoor temperature Tin and the indoor humidity RH start to gradually decrease from the time tm1, but the indoor temperature Tin is higher than the first temperature threshold T1ref. Therefore, the operation controller 40 controls both the indoor fans 33A and 33B to rotate at the high speed, regardless of the indoor humidity RH.

When the indoor temperature Tin becomes equal to or lower than the first temperature threshold T1ref at the time tm2, the operation controller 40 changes the rotation of the indoor fan 33B to the low-speed rotation while keeping the high-speed rotation of the indoor fan 33A. As a result, the sensible heat ratio decreases, so that a decrease in the indoor temperature is suppressed compared to before the rotation of the indoor fan 33B is changed to the low speed rotation. However, although a rate of decrease in the indoor temperature decreases, the indoor temperature gradually decreases even under this control.

Here, at a time tm3, the indoor humidity RH becomes equal to or lower than the first humidity threshold RH1ref, but the indoor temperature Tin is between the first temperature threshold T1ref and the second temperature threshold T2ref. Therefore, the operation controller 40 continuously controls the indoor fan 33A to keep rotating at the high speed and the indoor fan 33B to keep rotating at the low speed until a time tm4. As a result, the indoor humidity gradually decreases, but the indoor temperature also gradually decreases.

Next, at a time tm4, the indoor temperature Tin becomes equal to or lower than the second temperature threshold T2ref. At the time tm4, the indoor temperature Tin becomes equal to or lower than the second temperature threshold T2ref, and the indoor humidity RH is also lower than the first humidity threshold RH1ref. Therefore, the operation controller 40 changes the rotation of the indoor fan 33A from the high-speed rotation to the low-speed rotation and controls the indoor fan 33B to stop. As a result, the operation controller 40 can further suppress the cooling effect and prevent the indoor temperature from dropping too much. Further, the operation controller 40 can continuously measure the indoor temperature and the indoor humidity by controlling the indoor fan 33A to rotate at the low speed without controlling the indoor fan 33A to stop.

Thereafter, the indoor temperature Tin gradually rises after a time tm5 because the rotation of the indoor fan 33B has stopped. However, at the time tm5 and a time tm6, the indoor temperature Tin is equal to or lower than the second temperature threshold T2ref, and the indoor humidity RH is equal to or lower than the second humidity threshold RH2ref. Therefore, the operation controller 40 controls the indoor fan 33A to keep rotating at the low speed and the indoor fan 33B to keep stopped.

Here, when the indoor temperature Tin becomes higher than the second temperature threshold T2ref, the operation controller 40 changes the rotation of the indoor fan 33A to the high-speed rotation and the rotation of the stopped indoor fan 33B to the low-speed rotation.

Thereafter, when the indoor temperature Tin becomes equal to or lower than the second temperature threshold T2ref again while the indoor humidity RH is equal to or lower than the first humidity threshold RH1ref, the operation controller 40 controls the indoor fan 33B to stop (and the indoor fan 33A to keep rotating at the low speed). When the indoor temperature Tin becomes higher than the second temperature threshold T2ref, the operation controller 40 controls the indoor fan 33B to rotate at the low speed (and the indoor fan 33A to rotate at the high speed). By repeating this control to perform fine adjustments, the operation controller 40 can perform the dehumidifying operation that realizes a comfortable temperature-humidity environment that maintains a constant humidity while suppressing an excessive drop in the indoor temperature.

Figure 6:
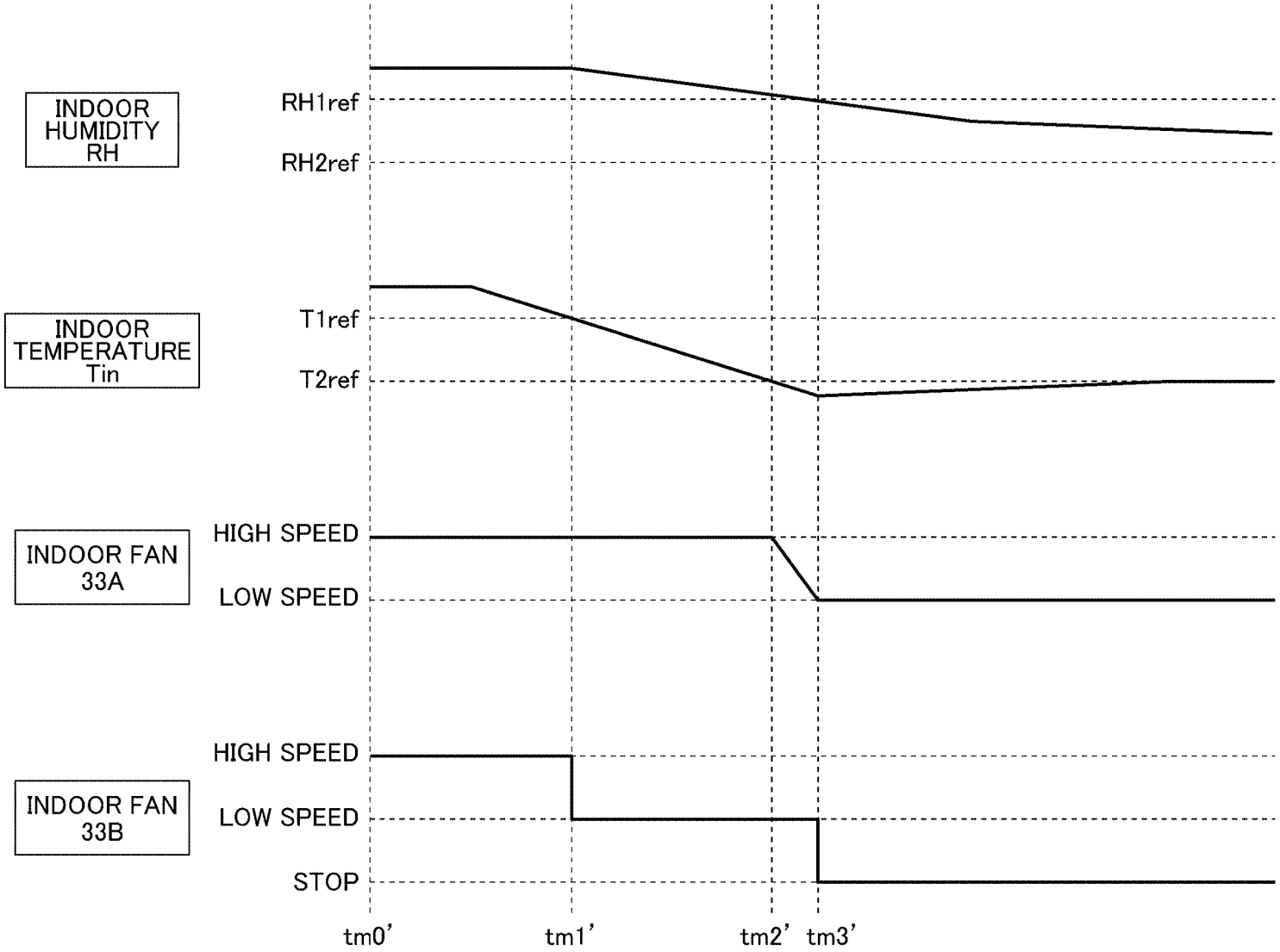
FIG. 6 is a timing chart showing another example of controlling the indoor fans during the dehumidifying operation according to the first embodiment.

FIG. 6 is a timing chart showing another example of controlling the indoor fans 33A and 33B during the dehumidifying operation. This FIG. 6 shows an example of controlling the indoor fans 33A and 33B during the dehumidifying operation in an operating state different from that in FIG. 5. The example shown in FIG. 6 shows a condition that a temperature of the indoor heat exchanger 32 (approximately blowout temperature) does not fall below a dew-point temperature, and the humidity does not easily decrease. Here, as in FIG. 5, a horizontal axis indicates time, and a vertical axis indicates indoor humidity RH, indoor temperature Tin, and control for the indoor fans 33A and 33B.

During a period from a time tm0' to a time tm1', the indoor temperature Tin is higher than the first temperature threshold T1ref. Therefore, the operation controller 40 controls both the indoor fans 33A and 33B to rotate at the high speed, regardless of the indoor humidity RH.

When the indoor temperature Tin becomes equal to or lower than the first temperature threshold T1ref at the time tm1', the operation controller 40 changes the rotation of the indoor fan 33B to the low-speed rotation while keeping the high-speed rotation of the indoor fan 33A. When the air volume decreases, the temperature of the indoor heat exchanger 32 drops to become equal to or lower than the dew-point temperature, and the humidity starts to drop. However, the indoor temperature gradually decreases.

At a time tm2', the indoor temperature Tin becomes equal to or lower than the second temperature threshold T2ref, but the indoor humidity RH is higher than the first humidity threshold RH1ref. Therefore, the operation controller 40 changes the rotation of the indoor fan 33A gradually from the high-speed rotation to the low-speed rotation. The indoor fan 33B is controlled to keep rotating at the low speed.

When the indoor humidity RH becomes equal to or lower than the first humidity threshold RH1ref at a time tm3', the operation controller 40 controls the indoor fan 33B to stop while continuously controlling the indoor fan 33A to keep rotating at the low speed. Due to the decrease in the indoor humidity, the operation controller 40 stops the rotation of the indoor fan 33B to further suppress the cooling effect. This can prevent the indoor temperature from dropping too much. Further, the operation controller 40 can continuously measure the indoor temperature and the indoor humidity by controlling the indoor fan 33A to keep rotating at the low speed.

Thereafter, the indoor temperature Tin gradually rises due to the stop of the rotation of the indoor fan 33B. However, until the indoor temperature Tin exceeds the second temperature threshold T2ref while the indoor humidity RH is equal to or lower than the first humidity threshold RH1ref, the operation controller 40 continuously controls the indoor fan 33A to keep rotating at the low speed and the indoor fan 33B to keep stopped.

Here, when the indoor temperature Tin becomes higher than the second temperature threshold T2ref, the operation controller 40 changes the rotation of the indoor fan 33A to the high-speed rotation, and controls the stopped indoor fan 33B to rotate at the low speed.

Thereafter, when the indoor temperature Tin becomes equal to or lower than the second temperature threshold T2ref again while the indoor humidity RH is equal to or lower than the first humidity threshold RH1ref, the operation controller 40 controls the indoor fan 33B to step (and the indoor fan 33A to keep rotating at the low speed). When the indoor temperature Tin becomes higher than the second temperature threshold T2ref, the operation controller 40 controls the indoor fan 33B to rotate at the low speed (and the indoor fan 33A to rotate at the high speed). By repeating this control to perform fine adjustments, the operation controller 40 can perform the dehumidifying operation that realizes a comfortable temperature-humidity environment that maintains a constant humidity while suppressing an excessive drop in the indoor temperature.

Further, by providing widths between the first temperature threshold T1ref and the second temperature threshold T2ref and between the first humidity threshold RH1ref and the second humidity threshold RH2ref, it is possible to realize comfortable space suitable for conditions of the room targeted for air conditioning, and to prevent hunting when the operation is switched.

As described above, the air conditioner 1 according to the present embodiment includes an outdoor unit 2, and a plurality of indoor units 3 connected with a refrigerant pipe through which a refrigerant sent from the one outdoor unit 2 flows. Each indoor unit 3 includes a refrigerant circuit 10 in which at least an indoor heat exchanger 32 is connected to the refrigerant pipe, an operation controller 40 configured to control the refrigerant circuit 10 according to an operating state, a sensor configured to measure an indoor environment (for example, temperature sensor 41, humidity sensor 42), and a plurality of indoor fans 33A and 33B configured to blow air to the indoor heat exchanger 32. Further, during a dehumidifying operation, the operation controller 40 is configured to control the plurality of indoor fans 33A and 33B respectively at different rotation speeds based on a result of the measurement by the sensor (for example, the temperature sensor 41, the humidity sensor 42).

As a result, the air conditioner 1 can control each of the plurality of indoor fans 33A and 33B respectively at the different rotation speeds based on a result of the measurement of the indoor environment, so that a setting range of the air volume is expanded, thereby making it possible to appropriately control a sensible heat ratio. This makes it possible to dehumidify a room while preventing the indoor temperature from dropping too much. Therefore, by performing a dehumidifying operation according to an indoor environment, the air conditioner 1 can realize a comfortable temperature-humidity environment that maintains a constant humidity while suppressing an excessive drop in the indoor temperature.

Further, in the indoor unit 3 including the plurality of indoor fans 33A and 33B, when the indoor fans 33A and 33B are operated at the same rotation speed, an offensive sound (beating sound) may occur. However, since the air conditioner 1 can individually control the plurality of indoor fans 33A and 33B at different rotation speeds, it is possible to perform quiet operation with reduced beat noise.

Further, the operation controller 40 is configured to, during the dehumidifying operation, control some indoor fan among the plurality of indoor fans 33A and 33B to rotate and the other indoor fan to stop, based on a result of the measurement by the sensor (for example, the temperature sensor 41, the humidity sensor 42).

As a result, for example, the air conditioner 1 controls the indoor fan 33A to rotate to keep the air blown to the temperature sensor 41 and the humidity sensor 42, thereby enabling measurements of an indoor temperature and an indoor humidity. Meanwhile, the air conditioner 1 controls the indoor fan 33B to step, thereby making it possible to suppress the amount of air blown to the indoor heat exchanger 32 and suppress the re-evaporation of moisture. Therefore, by performing a dehumidifying operation according to an indoor environment, the air conditioner 1 can realize a comfortable temperature-humidity environment that maintains a constant humidity while suppressing an excessive drop in the indoor temperature. That is, the air conditioner 1 can dehumidify the room while preventing the indoor temperature from dropping too much.

For example, when the temperature measured by the temperature sensor 41 is higher than a first temperature threshold T1ref, the operation controller 40 is configured to control each of the indoor fans 33A and 33B to rotate at a high speed (first rotation speed). On the other hand, when the temperature measured by the temperature sensor 41 is equal to or lower than the first temperature threshold T1ref, the operation controller 40 is configured to control some indoor fan (for example, the indoor fan 33A) among the plurality of indoor fans 33A and 33B to rotate at the high speed (first rotation speed), and other indoor fans (for example, the indoor fan 33B) than the some indoor fan to rotate at a low speed (second rotation speed lower than the first rotation speed).

As a result, the air conditioner 1 can individually and appropriately control each of the indoor fans 33A and 33B according to the indoor temperature, and can dehumidify the room while preventing the indoor temperature from dropping too much.

Further, when the temperature measured by the temperature sensor 41 is equal to or lower than a second temperature threshold T2ref, which is lower than the first temperature threshold T1ref, the operation controller 40 is configured to control the some indoor fan (for example, the indoor fan 33A) to rotate at a low speed (second rotation speed lower than the first rotation speed), and other indoor fans than the some indoor fan (for example, the indoor fan 33B) to stop rotating.

As a result, the air conditioner 1 can individually and appropriately control each of the indoor fans 33A and 33B according to the indoor temperature, and can dehumidify the room while preventing the indoor temperature from dropping too much.

Further, when the temperature measured by the temperature sensor 41 is equal to or lower than the second temperature threshold T2ref, but the humidity measured by the humidity sensor 42 is higher than a first humidity threshold RH1ref, the operation controller 40 is configured to control the plurality of indoor fans to rotate at the low speed (second rotation speed lower than the first rotation speed) without controlling the plurality of indoor fans to stop rotating. That is, when the humidity measured by the humidity sensor 42 is higher than the first humidity threshold RH1ref, the operation controller 40 controls the plurality of indoor fans to keep rotating.

As a result, the air conditioner 1 can individually and appropriately control each of the indoor fans 33A and 33B according to the indoor temperature and the indoor humidity, and can dehumidify the room while preventing the indoor temperature from dropping too much.

Here, after a certain period of time has elapsed, the operation controller 40 may switch between an indoor fan controlled to rotate at a relatively high speed (for example, the indoor fan 33A) and an indoor fan controlled to rotate at a relatively low speed (for example, the indoor fan 33B).

As a result, the air conditioner 1 switches at a constant frequency between an indoor fan rotating at the high speed and an indoor fan rotating at the low speed, thereby making it possible to increase the life of electric motors (for example, the actuators 331A and 331B) that cause the respective indoor fans to rotate.

Here, after a certain period of time has elapsed, the operation controller 40 may switch between an indoor fan controlled to rotate (for example, the indoor fan 33A) and an indoor fan controlled to stop (for example, the indoor fan 33B). When the temperature sensor 41 and the humidity sensor 42 are provided on the side of the indoor fan 33A as shown in FIG. 1, it is preferable to stop the indoor fan 33B, rather than the indoor fan 33A, in order to measure indoor environments. Even if the indoor fan 33A is stopped, as long as the indoor fan 33B is rotating, it is possible to measure indoor environments because both the temperature sensor 41 and the humidity sensor 42 take in air from the room as long as the intake air paths from the respective indoor fans are not completely partitioned. Further, the temperature sensor 41 and the humidity sensor 42 may be provided near the middle between the indoor fan 33A and the indoor fan 33B. Further, as in a second embodiment described later, when the temperature sensor 41 and the humidity sensor 42 are provided in a place other than the indoor unit 3, even if either the indoor fan 33A or the indoor fan 33B is stopped, it does not affect measurements of indoor environments.

Thus, the air conditioner 1 switches at a constant frequency between an indoor fan controlled to rotate and an indoor fan controlled to stop, thereby making it possible to increase the life of the electric motors (for example, the actuators 331A and 331B) that cause the respective indoor fans to rotate.

Second Embodiment

Next, a second embodiment will be described. In the first embodiment, the configuration example in which the sensors provided in the indoor unit 3 measure indoor environments has been described, but the sensors that measure indoor environments may be provided in a place other than the indoor unit 3.

Figure 7:
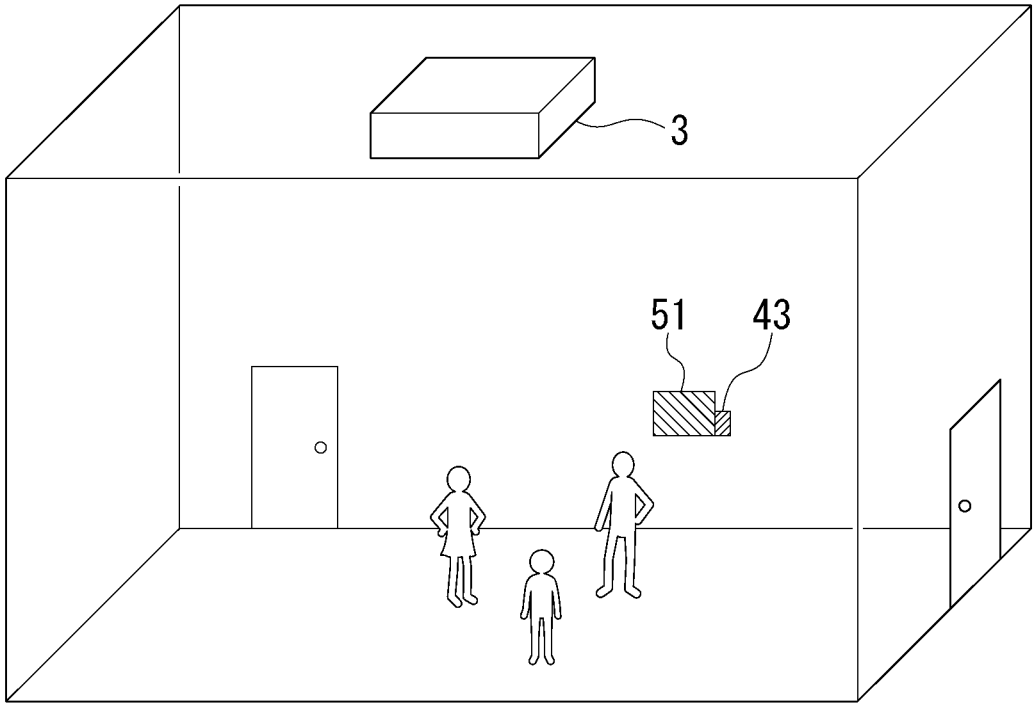
FIG. 7 is a perspective view showing an example of indoor space in which an indoor unit of an air conditioner according to a second embodiment is installed.

FIG. 7 is a perspective view showing an example of indoor space in which the indoor unit 3 of the air conditioner 1 according to the present embodiment is installed. Here, an example in which a ceiling-embedded indoor unit 3 is installed is shown. Since the indoor unit 3 is installed on the ceiling, it is installed at a position away from the space near the floor where people are present. This may be aimed at preventing the air blowing from the indoor unit 3 from hitting people directly, and the like, but due to the distance, an environment in the space where people are present and an environment near the indoor unit 3 may differ greatly. Here, not only in the case of the ceiling-mounted type, but also in the cases of the ceiling-suspended type and the wall-mounted type, the place where the indoor unit 3 is installed and the space where people are present may be distant. In such cases, if the indoor fans 33A and 33B are controlled based on the environments measured by the sensors which measure the indoor environments and which are provided in the indoor unit 3, there is a possibility that comfort will be significantly decreased.

Therefore, in the present embodiment, a separate sensor 43 that measures the indoor environments is provided at a place other than the indoor unit 3. For example, the separate sensor 43 is provided inside, or on an outer surface of a housing of, a remote controller 51. The remote controller 51 is a remote controller for remotely operating the indoor unit 3, and is communicatively connected to the indoor unit 3 by wire or wirelessly. The separate sensor 43 includes at least one or both of a temperature sensor and a humidity sensor. By acquiring results of measurements of an indoor temperature and an indoor humidity from the separate sensor 43, the operation controller 40 can acquire a temperature and a humidity of a place closer to the space where people are present.

For example, by controlling the actuators 331A and 331B based on the results of the measurements by the separate sensor 43, the operation controller 40 controls the rotation and stop of the indoor fans 33A and 33B, and the number of rotations (rotation speed) of the indoor fans 33A and 33B during rotation, and the like. Thus, by controlling the indoor fans based on the results of the measurements by the separate sensor 43 provided in the remote controller 51, the operation controller 40 can perform the dehumidifying operation without decreasing comfort.

Here, when the operation controller 40 controls the indoor fans 33A and 33B based on the results of the measurements by the separate sensor 43, the indoor unit 3 may be configured not to include the temperature sensor 41 and the humidity sensor 42. Alternatively, the operation controller 40 may control the indoor fans 33A and 33B based on the results of the measurements by the separate sensor 43 without using the results of the measurements by the temperature sensor 41 and the humidity sensor 42 provided in the indoor unit 3.

Here, the operation controller 40 may control the indoor fans 33A and 33B based on both the results of the measurements by the separate sensor 43 and the results of the measurements by the temperature sensor 41 and the humidity sensor 42 provided in the indoor unit 3. For example, the operation controller 40 may control the indoor fans 33A and 33B based on a result of the measurement by the sensor which indicates the lower temperature measured, among the results of the measurements by the separate sensor 43 and the results of the measurements by the temperature sensor 41 and the humidity sensor 42 provided in the indoor unit 3. Alternatively, the operation controller 40 may control the indoor fans 33A and 33B based on an average or weighted average of the results of the measurements by the separate sensor 43 and the results of the measurements by the temperature sensor 41 and the humidity sensor 42 provided in the indoor unit 3.

As described above, in the air conditioner 1 according to the present embodiment, the sensors that measure indoor environments (for example, the temperature sensor 41, the humidity sensor 42) are provided at a place other than the indoor unit 3.

As a result, even if the place where the indoor unit 3 is installed and the space where people are present are distant from each other, the sensors (for example, the temperature sensor 41, the humidity sensor 42) that measure indoor environments can be installed in the vicinity of the space where people are present, so that the air conditioner 1 can perform an appropriate operation according to the indoor environments.

For example, the sensors that measure indoor environments (for example, the temperature sensor 41, the humidity sensor 42) are provided in the remote controller 51 configured to operate the indoor unit 3.

As a result, since the sensors that measure indoor environments (for example, the temperature sensor 41, the humidity sensor 42) are provided in the remote controller 51 operated by a person, the air conditioner 1 can perform an appropriate operation according to the indoor environments. Further, since the air conditioner 1 can acquire results of the measurements by the sensors using communication with the remote controller 51, it can be easily realized at a lower cost than separately preparing a sensor device having a communication function.

As described above, although each of the embodiments has been described in detail with reference to the drawings, the specific configuration is not limited to these embodiments, and each embodiment may be combined, modified, or omitted as appropriate.

Although the remote controller 51 is illustrated as an example of a terminal device that communicates with the indoor unit 3, a smart phone, a tablet-type PC (Personal Computer), or the like may be used instead of the remote controller 51. Further, a smartphone or a tablet PC may be provided with a temperature sensor, a humidity sensor, and the like.

In the above embodiments, although the example where the operation controller 40 included in the indoor unit 3 controls the indoor fans 33A and 33B has been described, the outdoor unit 2 may acquire results of measurements of indoor environments from each of the plurality of indoor units 3 (3A and 3B), and control the indoor fans 33A and 33B of a respective one of the plurality of indoor units 3 (3A and 3B).

Further, as described above, the number of indoor units 3 connected to the outdoor unit 2 is not limited to two, and may be three or more. Further, the number of indoor fans included in one indoor unit 3 is not limited to two, and may be three or more.

Here, a program for realizing the functions of the operation controller 40 may be recorded in a computer-readable recording medium, so that a computer system can read and execute the program recorded in the recording medium to perform the processing of the operation controller 40. Here, the "computer system" referred to here includes an OS and hardware such as peripheral devices.

Further, the "computer-readable recording medium" refers to portable media such as flexible disks, magneto-optical disks, ROMs and CD-ROMs, and storage devices such as hard disks built into computer systems. Further, the "computer-readable recording medium" includes: a medium that dynamically retains a program for a short period of time, such as a communication line in a case where the program is transmitted via a network such as the Internet or a communication line such as a telephone line; and a medium that retains a program for a certain period of time, such as a volatile memory inside a computer system that serves as a server or a client in the above case. Further, the above-described program may be one for realizing part of the functions described above, or may be one capable of realizing the functions described above in combination with a program already recorded in the computer system. Further, the above-described program may be stored in a predetermined server, so that it will be distributed (downloaded, or the like) via a communication line in response to a request from another device.

Further, part or all of the functions of the operation controller 40 may be implemented as an integrated circuit such as an LSI (Large Scale Integration). Each function may be individually processorized, and part or all of the functions may be integrated and processorized. Further, the integrated circuit is not limited to an LSI, and may be implemented as a dedicated circuit or a general-purpose processor. Further, when an integrated circuit technology that replaces the LSI appears due to advances in semiconductor technology, an integrated circuit based on that technology may be used.

The invention claimed is:

1. An air conditioner comprising:

a humidity sensor configured to measure an indoor humidity;

one outdoor unit;

at least two indoor units connected with a refrigerant pipe through which a refrigerant sent from the one outdoor unit flows; and a temperature sensor configured to measure an indoor temperature, wherein each of the at least two indoor units comprises:

a refrigerant circuit in which at least an evaporator is connected to the refrigerant pipe;

an operation controller configured to control the refrigerant circuit according to an operating state; and at least two indoor fans configured to blow air to the evaporator, wherein each of the operation controllers is configured to determine whether the indoor humidity measured by the humidity sensor is equal to or lower than a first preset humidity threshold, determine whether the indoor humidity measured by the humidity sensor is equal to or lower than a second preset humidity threshold lower than the first preset humidity threshold, during a dehumidifying operation, when the indoor humidity measured by the humidity sensor is equal to or lower than the second preset humidity threshold, perform a first controlling operation to control at least one indoor fan among a corresponding at least two indoor fans to not rotate, and during the dehumidifying operation, when the indoor humidity measured by the humidity sensor is equal to or lower than the first preset humidity threshold and higher than the second preset humidity threshold, perform a second controlling operation to control at least one indoor fan among the corresponding at least two indoor fans to not rotate, during the dehumidifying operation, when the indoor humidity measured by the humidity sensor is higher than the first preset humidity threshold, perform a third controlling operation to control the corresponding at least two indoor fans to rotate, and wherein each of the operation controllers is configured to determine whether the indoor temperature measured by the temperature sensor is equal to or lower than a second preset temperature threshold, perform the first, second, and third controlling operations only when the indoor temperature is equal to or lower than the second preset temperature threshold.

2. The air conditioner according to claim 1, wherein a first preset temperature threshold higher in temperature than the second preset temperature threshold is preset, and the corresponding at least two indoor fans are divided into a first group of indoor fans and a second group of indoor fans, the first group of indoor fans including at least one first indoor fan from the corresponding at least two indoor fans, and second group of indoor fans including at least one second indoor fan from the corresponding at least two indoor fans, and each of the operation controllers is configured to when the indoor temperature measured by the temperature sensor is higher than the first preset temperature threshold, perform a fourth controlling operation to control each of the corresponding at least two indoor fans to rotate at a first rotation speed, and when the indoor temperature measured by the temperature sensor is equal to or lower than the first preset temperature threshold and higher than the second preset temperature threshold, perform a fifth controlling operation to control the first group of indoor fans to rotate at the first rotation speed, and the second group of indoor fans to rotate at a second rotation speed lower than the first rotation speed.

3. The air conditioner according to claim 1, wherein each of the operation controllers is configured to, after a predetermined period of time has elapsed, switch between an indoor fan controlled to rotate and an indoor fan controlled to stop rotating.

4. The air conditioner according to claim 1, wherein at least one of the temperature sensor and the humidity sensor is provided in a place other than the at least two indoor units.

5. The air conditioner according to claim 4, further comprising:

one or more remote controllers each configured to operate a respective one of the at least two indoor units, wherein the at least one of the temperature sensor and the humidity sensor is provided in the one or more remote controllers.

6. The air conditioner according to claim 1, wherein each of the at least two indoor units comprises at least one of the temperature sensor and the humidity sensor.

7. The air conditioner according to claim 1, wherein among the at least two indoor units connected to the one outdoor unit, at least a first indoor unit performs a cooling operation, and at least a second indoor unit performs the dehumidifying operation.

8. The air conditioner according to claim 1, wherein the operation controller is configured to, after a predetermined period of time has elapsed, switch between an indoor fan controlled to rotate and an indoor fan controlled to stop rotating.

9. A control method for an air conditioner comprising one outdoor unit and at least two indoor units, each of the at least two indoor units comprising at least two indoor fans, the control method comprising:

determining using an operation controller of one of the at least two indoor units, whether an indoor humidity is equal to or lower than a first preset humidity threshold, determining, using the operation controller whether the indoor humidity is equal to or lower than a second preset humidity threshold lower than the first preset humidity threshold, performing a first controlling operation to control at least one indoor fan among a corresponding at least two indoor fans in one of the at least two indoor units to not rotate in response to the operation controller determining that the indoor humidity is equal to or lower than the second preset humidity threshold during a dehumidifying operation, wherein a first preset temperature threshold and a second preset temperature threshold lower than the first preset temperature threshold are preset, the corresponding at least two indoor fans are divided into a first group of indoor fans and a second group of indoor fans, the first group of indoor fans including at least one first indoor fan from the corresponding at least two indoor fans, and second group of indoor fans including at least one second indoor fan from the corresponding at least two indoor fans, the first controlling operation is performed only when an indoor temperature is equal to or lower than the second preset temperature threshold, and the control method further comprises:

performing a fourth controlling operation to control each of the corresponding at least two indoor fans to rotate at a first rotation speed in response to the indoor temperature being higher than the first preset temperature threshold.

10. The control method according to claim 9, further comprising:

after a predetermined period of time has elapsed, switching between an indoor fan controlled to rotate and an indoor fan controlled to stop rotating.

11. The control method according to claim 9, further comprising:

measuring the indoor humidity by a humidity sensor; and measuring the indoor temperature by a temperature sensor, wherein at least one of the humidity sensor and the temperature sensor is provided in a place other than the at least two indoor units.

12. The control method according to claim 11, further comprising:

the at least one of the humidity sensor and the temperature sensor is provided in one or more remote controllers each configured to operate a respective one of the at least two indoor units.

13. The control method according to claim 9, further comprising:

measuring the indoor humidity by a humidity sensor; and measuring the indoor temperature by a temperature sensor, wherein at least one of the humidity sensor and the temperature sensor is included in each of the at least two indoor units.

14. The control method according to claim 9, further comprising:

performing a cooling operation by at least a first indoor unit among the at least two indoor units connected to the one outdoor unit; and performing the dehumidifying operation by at least a second indoor unit among the at least two indoor units.

15. The control method according to claim 9, further comprising:

after a predetermined period of time has elapsed, switching between an indoor fan controlled to rotate and an indoor fan controlled to stop rotating.

16. The control method according to claim 9, further comprising:

performing a second controlling operation to control at least one indoor fan among the corresponding at least two indoor fans to not rotate in response to the operation controller determining that the indoor humidity is equal to or lower than the first preset humidity threshold and higher than the second preset humidity threshold during the dehumidifying operation.

17. The control method according to claim 9, further comprising:

performing a third controlling operation to control the corresponding at least two indoor fans to rotate in response to the operation controller determining that the indoor humidity is higher than the first preset humidity threshold during the dehumidifying operation.

18. The control method according to claim 9, further comprising:

performing a fifth controlling operation to control the first group of indoor fans to rotate at the first rotation speed, and the second group of indoor fans to rotate at a second rotation speed lower than the first rotation speed in response to the indoor temperature being equal to or lower than the first preset temperature threshold and higher than the second preset temperature threshold.

* * * * *